US006347591B1

(12) United States Patent
Karpa et al.

(10) Patent No.: US 6,347,591 B1
(45) Date of Patent: Feb. 19, 2002

(54) TABLE AND METHOD

(76) Inventors: Jonathan S. Karpa, 5225 Pooks Hill Rd. Unit 1314 South, Bethesda, MD (US) 20814; Scott A. Binder, 10909 Cartwright Pl., North Potomac, MD (US) 20878

( * ) Notice: Subject to any disclaimer, the term of this patent is extended or adjusted under 35 U.S.C. 154(b) by 0 days.

(21) Appl. No.: 09/635,136

(22) Filed: Aug. 9, 2000

(51) Int. Cl.[7] ..... A47B 37/00
(52) U.S. Cl. ..... 108/50.11; 108/59; 108/25
(58) Field of Search ..... 108/150, 50.11, 108/59, 42, 151, 10, 166; 312/196

(56) References Cited

U.S. PATENT DOCUMENTS 1,890,409 A 12/1932 Roberts
2,799,543 A 7/1957 Tomaselli
3,620,174 A 11/1971 Dentino
4,383,487 A * 5/1983 Fitzner et al. ..... 108/150
4,559,877 A 12/1985 Waibel
4,922,835 A 5/1990 Van Vliet et al.
5,086,712 A 2/1992 Clark
5,335,803 A 8/1994 O'Brien et al.
5,438,937 A 8/1995 Ball et al.
6,032,590 A 3/2000 Chen

* cited by examiner

*Primary Examiner*—Peter M. Cuomo
*Assistant Examiner*—Jerry A. Anderson
(74) *Attorney, Agent, or Firm*—Liniak, Berenato, Longacre & White

(57) ABSTRACT

A table construction and method is provided having an internal opening that selectively accommodates a floor lamp or torchier and allows the insertion and removal of the lamp from the opening in a horizontal plane without disassembling the lamp and without requiring the component pieces of the table to be completely separated.

12 Claims, 5 Drawing Sheets

TABLE AND METHOD

FIELD OF INVENTION

The present invention relates to tables. More particularly, the present invention relates to a table having an interior opening for selectively accommodating a floor lamp or torchier. The floor lamp or torchier can easily be inserted or removed from the interior opening without disassembling the lamp requiring the component pieces of the table to be completely separated, or passing the lamp vertically through the tabletop.

BACKGROUND OF THE INVENTION

Table constructions of various types are generally well known in the art and typically contain some sort of base supporting a tabletop. It is also quite common to utilize lights on or in close proximity to tables for the purposes of providing task or ambience lighting. The most commonly used type of lighting is a table lamp, the bottom of which rests on the tabletop. Such a configuration, however, provides a risk that the lamp could be easily knocked over and also usually leaves the electrical cord of the lamp exposed across the surface of the tabletop. Floor lamps, such as torchiers, have also been generally known in the art for some years. Such lamps generally comprise a base that rests on the floor and provide indirect lighting with a source of light located within a reflecting bowl. Such lamps are difficult to use in combination with tables since they are not designed to rest on a tabletop and cannot be located within the interior of the tabletop unless a hole is provided in the table itself.

Further complicating the use of a floor lamp or torchier in a table having a hole on the surface thereof, is the fact that most of these lamps are not separable into two parts along the midsection between the base and the light and usually contain a cord that runs continuously along the entire length of the lamp. Therefore, in order to insert such a lamp through a table having an interior opening, the opening must have a diameter that is at least slightly larger than either the lamp portion or the base of the lamp. In order to insert or remove the lamp, the lamp must be passed from below the tabletop to a point above the top, or vice versa. An opening of such a large diameter in the tabletop effectively diminishes usefulness of the table by removing a large portion of the tabletop for other uses.

Although several table constructions are known in the art that have an interior or central opening, they each present some rather significant drawbacks to accommodating a floor lamp or torchier. For example, U.S. Pat. Nos. 1,890,409 to Roberts, 2,799,543 to Tomaselli, and 5,086,712 to Clark all teach table constructions having a central aperture. The aperture in each of these tables, however, allows for insertion of an umbrella or the like only by lowering it vertically through the central opening such that the leading end of the umbrella must pass from a point above the tabletop through the opening to a point below the tabletop where it ultimately rests on the surface that the table is on. These constructions do not permit the user to insert an umbrella or the like into the central opening by passing the umbrella from the edge region of the table to the central opening. In addition, the diameter of the central opening must be as wide as the base of the umbrella or other device to allow it to be passed through the opening. None of these constructions can accommodate a floor lamp or torchier having a base and end that is wider than and contiguous with its midsection.

Other table constructions are known that provide a central opening that can be accessed by passing a lamp or the like along a horizontal plane from the edge of the table to the central opening. These constructions, however, such as those illustrated in U.S. Pat. No. 5,335,803 to O'Brien, et al. and Waibel U.S. Pat. No. 4,559,877, require that an entire section of the table be completely removed and separated from contact with the remaining table section in order to permit insertion of a lamp or the like into the central opening. Such constructions also usually require that some sort of fastening retaining element first be released to allow the section to be removed from the table. The section must then be realigned and refastened to the table as a whole once the insertion is complete. Such an operation is cumbersome, extensive, requires tools and undue time and space in order to accomplish insertion of a lamp into the central opening. This can be particularly problematic where the table is being used in a small room, which may have been the very reason for using a floor lamp extending through the table in the first place.

It is therefore apparent that there exists a need in the art for an improved table construction having an internal opening that would easily and simply permit insertion and removal of a table lamp or torchier without the aforesaid drawbacks of prior known constructions.

SUMMARY OF THE INVENTION

It is, therefore, an object of the present invention to overcome the drawbacks of the prior art and provide a table assembly and method which can easily and conveniently permit insertion and removal of a floor lamp or torchier into an interior opening without having to pass one of the ends of the lamp through the opening and without necessitating the complete removal or separation of a segment of the table.

The table is composed of a tabletop that has two sections that are hinged to one another at a point near one of their respective ends so as to allow for a pivoting movement of the sections in a horizontal plane to allow a floor lamp or torchier to be passed from a point outside the edge of the tabletop to an opening in the interior of the tabletop that is formed when the two sections are pivoted to bring them in close proximity to one another along an entire edge thereof and close the central opening with the lamp therein. The construction of the present invention allows a floor lamp or torchier to be selectively inserted and removed into an interior opening formed by the two sections of the tabletop by moving it in a horizontal plane without completely removing or separating one of the sections of the tabletop. As such, the present invention permits ease of insertion of the floor lamp or torchier into the interior opening of the table without passing an end of the lamp through the opening. The present invention also permits accurate realignment of the tabletop sections once the lamp is inserted and the sections are pivoted back toward one another since the sections never completely lose contact with one another during the process. The present invention can best be understood through the following description and accompanying drawings, wherein:

DETAILED DESCRIPTION OF CERTAIN PREFERRED EMBODIMENTS

Figure 1:
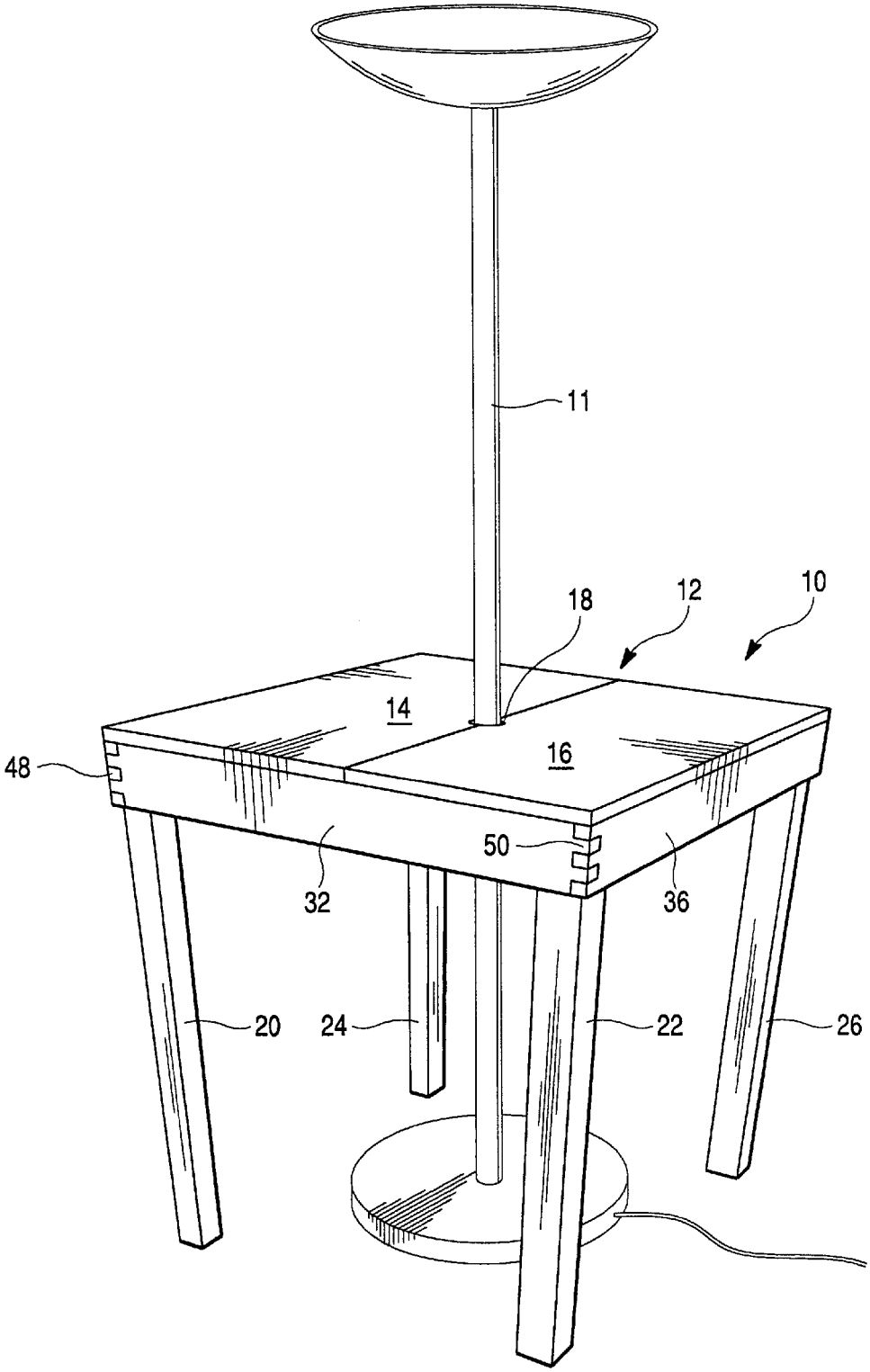
FIG. 1 is a perspective view of the present invention in a closed orientation.
Figure 2:
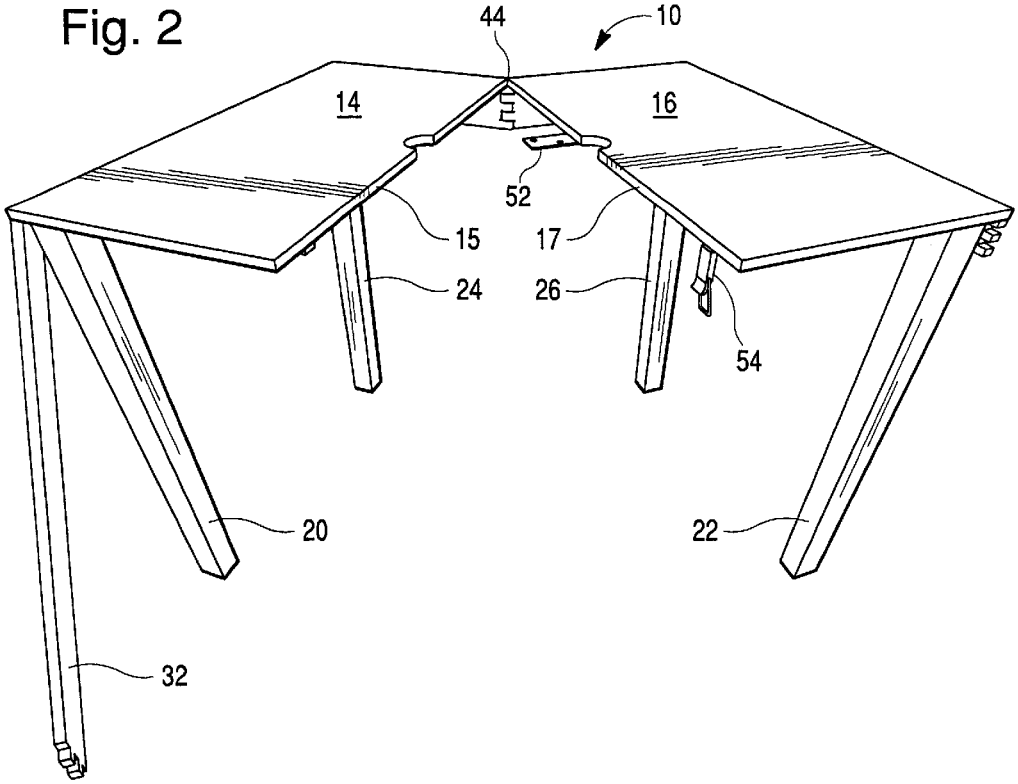
FIG. 2 is a perspective view of the present invention in an open configuration.
Figure 3:
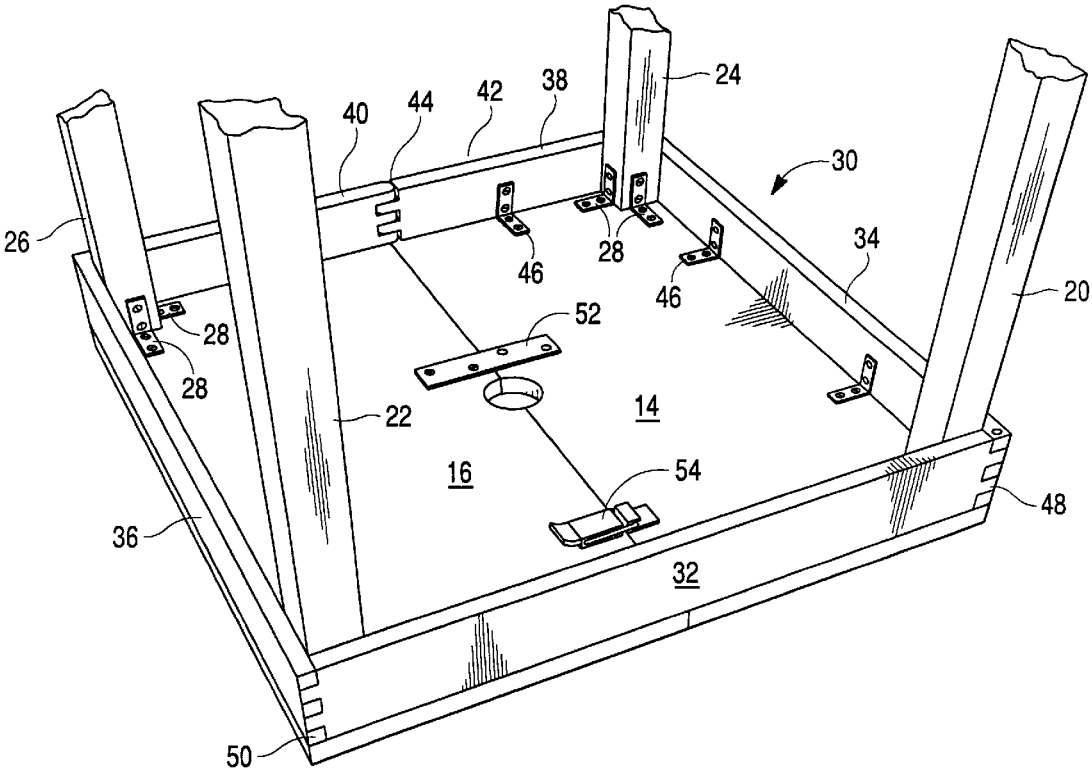
FIG. 3 is a bottom view of the present invention in a closed configuration.
Figure 4:
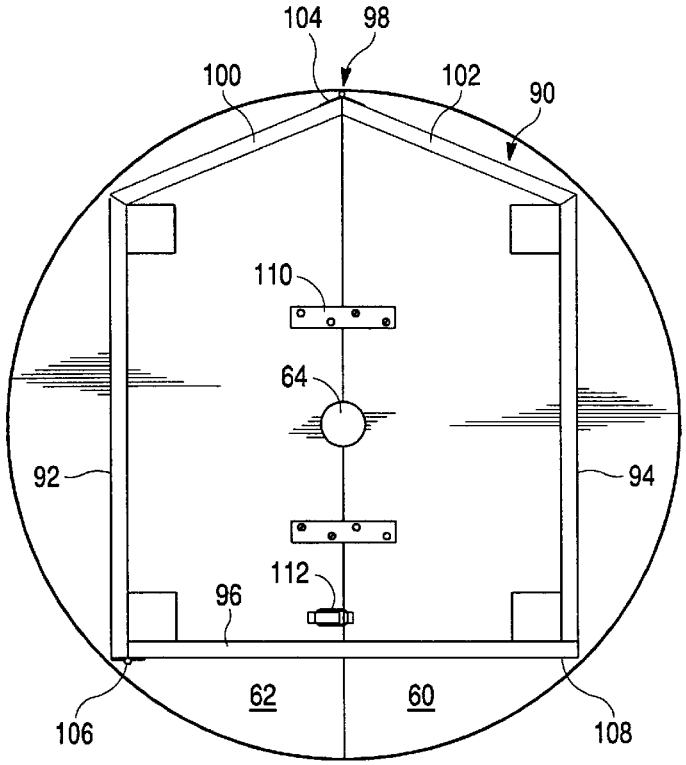
FIG. 4 is a bottom view of an alternative embodiment of the present invention in a closed configuration.
Figure 5:
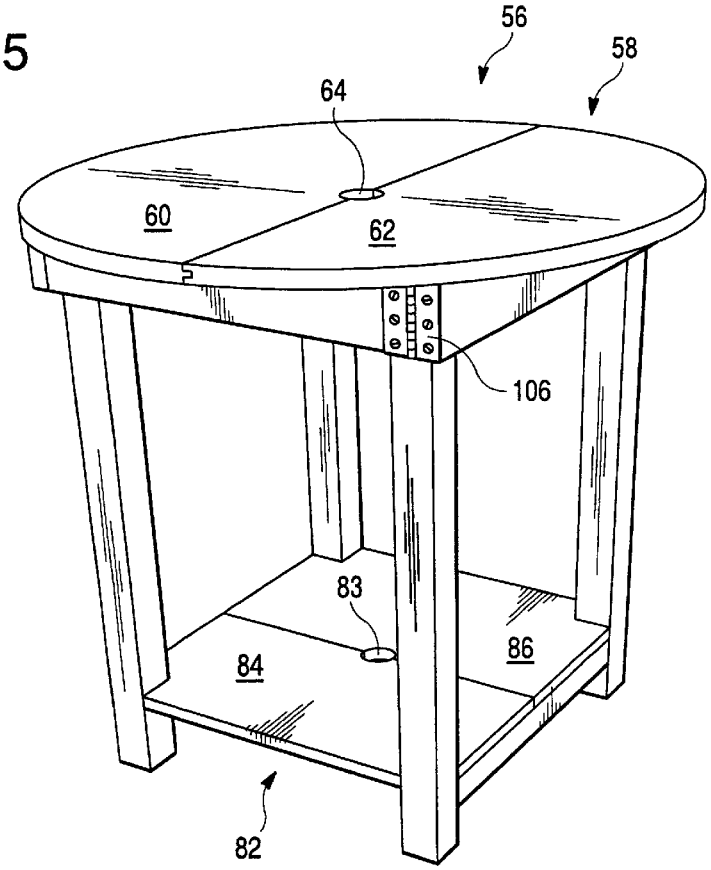
FIG. 5 is a perspective view of another embodiment of the present invention in a closed configuration.

Referring now to FIGS. 1–3, a preferred embodiment of a rectangular table 10 in accordance with the present invention 10 is illustrated. The table 10 has a tabletop 12 composed of two sections, 14 and 16 respectively. A hole 18 is provided through an interior portion of the tabletop 12. The outer circumference of the hole 18 is located in part in section 14 and in section 16. The tabletop 12 is preferably supported a predetermined distance from the floor or other surface by a base. A wide variety of standard table bases can be utilized as long as they do not block the hole 18. A preferred form of base is illustrated in the form of a plurality of legs, 20, 22, 24 and 26 respectively, that are located near the corners of the tabletop 12. Legs 20, 22, 24 and 26 are preferably rigidly attached to the underside of the tabletop 12 by gluing, brackets 28 and/or other similar known attachment mechanisms.

The table 10 is also provided with an apron 30 that extends down from the underside of the tabletop along the entire outer edge of the table. The apron 30 consists of a front swing arm 32, side panels, 34 and 36 respectively, and a rear panel 38. The rear panel 38 is composed of two subpanels 40 and 42 respectively that are pivotly connected at one end by a hinge 44. The side panels 34 and 36 and subpanels 40 and 42 are all preferably rigidly connected to the underside of the tabletop 12 by brackets 46 or other similar known fastening mechanisms. The front swing arm 32 is pivotly connected to the side panel 34 by a hinge 48. The opposite end of the front swing arm 32 is releasably connected to the side panel 34 by means of a connecting mechanism 50 or similar joining mechanism. The swing arm 32 could optionally be provided with a hook to releasably attach it to the panel 36. Additionally, the inner surface of the arm 32 and the facing surface of the leg 22 could be provided with magnets or similar releasable catch mechanism instead of or in combination with the joint 50.

The tabletop 12 can also be provided with a plate 52 that is attached to the under surface of one of the sections 14 or 16 of the tabletop 12 and runs under the opposite section of 14 or 16, respectively, but is not rigidly attached thereto. The plate provides a reinforcement to the tabletop in the area where it separates and also assists in maintaining the surface of the tabletop in a substantially flat condition. The underside of the tabletop 12 can also be provided with a releasable attachment mechanism such as a clasp 54 or other similar known mechanism. A portion of the clasp 54 is mounted to both the sections 14 and 16 of the tabletop 12. The clasp 54 further assists in maintaining the table in a closed configuration when it is in use. It can be easily released to permit separation of the sections 14 and 16 to allow insertion or removal of a torchier or floor lamp in the hole 18.

The operation of the table is now discussed with reference to FIGS. 1–3. In order to permit the insertion of a floor lamp or torchier through the hole 18, the swing arm 32 is moved away from the joint 50 and pivoted outwardly away from the tabletop 12 using the hinge 48. The clasp 54 is released to allow the sections 14 and 16 to be moved away from one another. Either one or both of the sections 14 and 16 are pivoted away from one another to permit access to the central opening 18 in a horizontal plane to enable insertion of a floor lamp or torchier into the opening 18 without requiring an end of the lamp to be passed through the opening 18.

The hinge 44 permits the pivoting movement of the sections 14 and 16 to allow such access to the hole 18 and at the same time maintains a connection between the sections 14 and 16. This construction permits several other advantages. First, no additional support elements need to be added or utilized in the table when it is in an open condition other than those that support the table when it is in a closed configuration. Additionally, the fact that the hinge 44 maintains the sections 14 and 16 in contact also ensures that the sections will be in alignment and connected when they are brought back together in a closed configuration after being opened without the use of any additional mechanism. The present invention permits the insertion of the lamp by simply moving it from a position outside the outer edge of the table towards the interior of a table where the hole 18 is located. Opening the table sufficiently to allow insertion or removal of a lamp requires very little floor space beyond the footprint of the closed table. It should also be understood that where space or other considerations dictate, access to the hole 18 can be achieved by pivoting either the section 14 or the section 16 while leaving the other section stationary or by pivoting both sections away from one another.

Once the lamp or torchier is inserted in the hole 18, one or both of the sections 14 and 16 are then moved until their edges 15 and 17 are in close proximity or in contact with one another and the inner circumference of the hole 18 completely surrounds the lamp 11. At this point, the clasp 54 is reattached so as to prevent the sections 14 and 16 from inadvertently moving away from one another. The swing arm 32 is then pivoted back into its closed position using the hinge 48 until the joint 50 is closed.

An alternative embodiment of a table construction in accordance with the present invention is illustrated in FIGS. 4–7. The table construction illustrated in this embodiment utilizes a circular tabletop 58. It should be understood the present invention can be utilized in connection with virtually all manner of tabletop shapes, in addition to those illustrated and described herein. The tabletop 58 is composed of two sections 60 and 62 respectively that can be selectively pivoted away from one another. When they are brought together, a portion of the internal edges of the section 60 and 62 form an internal hole 64 in the tabletop 58. One section 60 of the tabletop 58 of this embodiment is provided with an outwardly extending tongue 66 at its edge which cooperates with and is received by a complementary groove 68 in the opposing section 62. This construction assists in alignment of the tabletop and also helps support the tabletop 58 when the sections 60 and 62 are brought together in order to strengthen the table and align the table in a substantially flat condition. Four legs, 70, 72, 74 and 76 respectively, are rigidly attached to the underside of the tabletop 58 and support the tabletop a predetermined distance above the floor or other surface. These legs are attached near the outer circumference of the tabletop. It should be understood that other configurations of table bases could be used in accordance with the present invention as long as they do not interfere with the vertical plane that extends through the hole 64.

In this embodiment, the legs 70, 72, 74 and 76 are provided with longitudinal braces 78 and 80. The braces serve not only to stabilize the legs but also to provide a base for an optional removable shelf 82. The shelf 82 is comprised of two removable sections 84 and 86. The internal edges of the sections 84 and 86 each contain a cutout that together form the circumference of a hole 88 to accommodate the pole of a torchier or floor lamp. The hole 88 must align with the hole 64.

The underside of the table is also connected to an apron 90. The apron 90 is composed of two parallel side panels 92 and 94, a front swing arm 96, and a rear panel 98. The rear panel features two subpanels, 100 and 102 respectively, that are joined at one end for rotational movement by a hinge 104. The front swing arm 96 is joined at one end for rotational movement to side panel 92 by the hinge 106. The apron 90 is also preferably rigidly secured to the legs 70, 72, 74 and 76 by the use of brackets, dowels or other known constructions. The end 108 of the arm 96 may be pivoted away from the panel 94 in order to permit the sections 60 and 62 to be moved either separately or simultaneously away from one another in order to permit insertion of a floor lamp or torchier into the hole 64 by moving the lamp from the outer edge of the table in a horizontal plane to the hole 64. The underside of the tabletop 58 can also optionally include one or more plates 110 that have one end rigidly connected to one of the sections 60 or 62 and an opposite end underlying the other section for support. A clasp 112 or similar attachment mechanism can also be utilized on the underside of the tabletop as previously described.

In this embodiment illustrated in FIGS. 4–7, the apron is not a square. It is generally desired to maximize the size of the square portion of the apron within the circle of the tabletop in order to determine the appropriate angles and lengths for the components of the apron. The mathematics utilized to do this and to determine the appropriate lengths and angles for the components of the apron are set forth below and are represented schematically in FIG. 7.

Pythagorean Theorem=$x^2+y^2=z^2$ r=radius of circle

Diameter=2×r

Circumference=2×PI×r

Area=PI×$r^2$

Length of Circular Arc (in degrees)=θ×(PI/180)×r

Area of Circle Sector (in degrees)=(θ/360)×PI×$r^2$ r=x=y $x^2+y^2=z^2$ b=½z b=d $b^2+d^2=x^2$ a=r−d $a^2+b^2=c^2$ cos θ=b/c Angle in degrees=$\cos^{-1}$ b/c=θ cos ϕ=a/c

Angle in degrees=$\cos^{-1}$ a/c=ϕ

Figure 6:
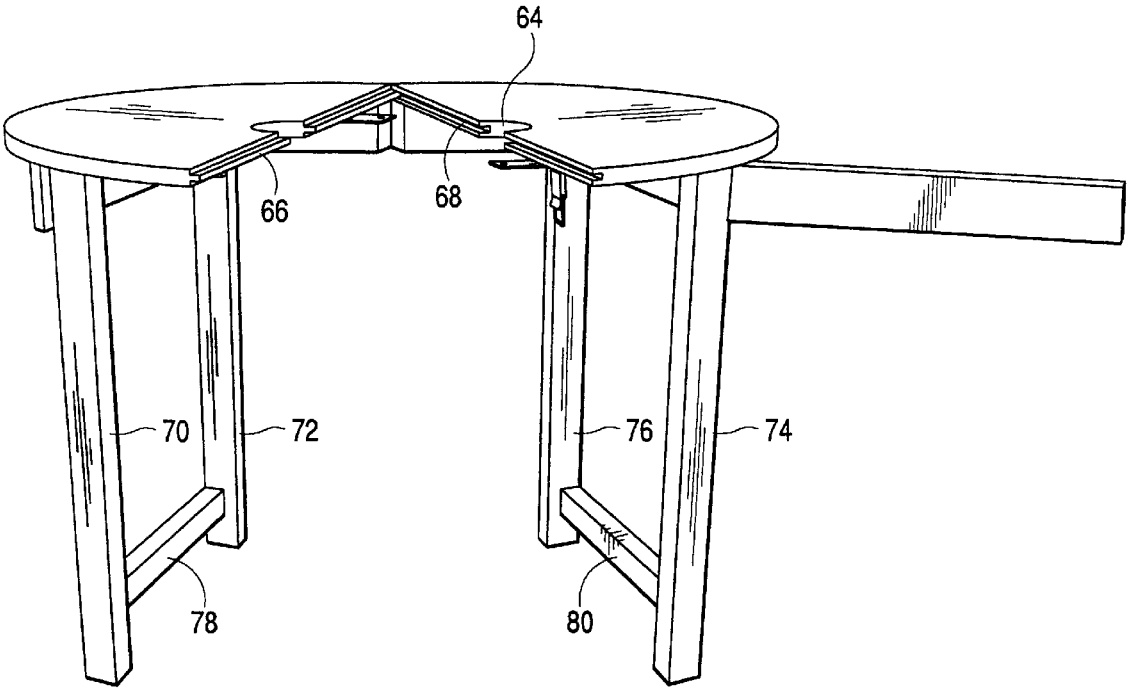
FIG. 6 is a perspective view of another embodiment of the present invention in an open configuration.
Figure 7:
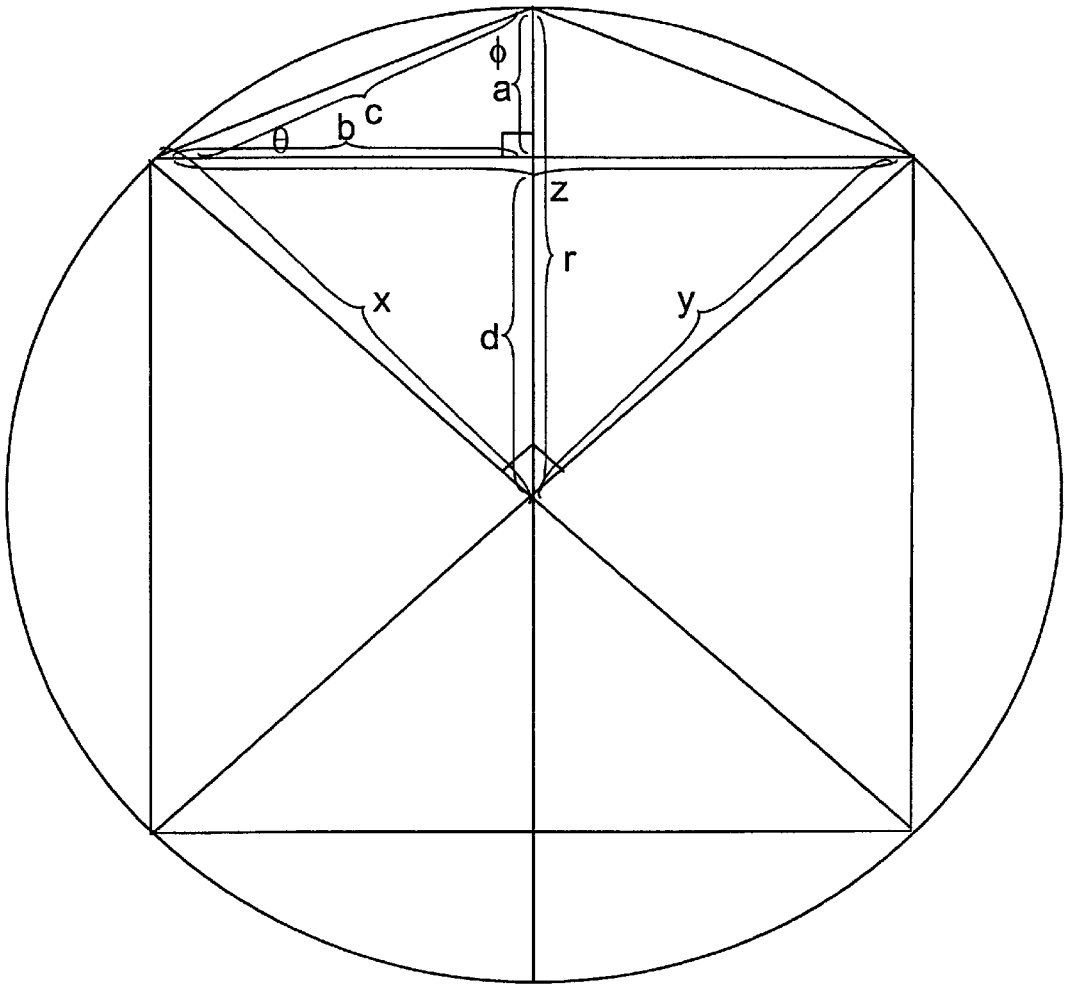
FIG. 7 is a schematic illustration of the embodiment of the invention illustrated in FIG. 4.

Insertion and removal of a floor lamp or torchier from the table 56 is accomplished much in the same way as previously described with respect to the prior embodiment of the table 10. To move the table 56 from a closed configuration to an open configuration, the end 108 of the front swing arm 96 is pivoted away from the side panel 94 as illustrated in FIG. 6. The swing arm 96 may have been either press fitted against the leg 70 and/or the side panel 94 or may have been retained in position by use of a hook or a magnet. If an alternative fasting system is utilized, it must be released prior to pivoting the swing arm 96. Next, the clasp 112 is released and the shelf 82 is removed. One or both of the sections, 60 and 62 respectively, of the tabletop 58 are then pivoted away from the other in order to permit access to the hole 64. Once the floor lamp or torchier is inserted in the hole 64, the steps indicated are then reversed and repeated.

Once given the above disclosure, many other features, modifications, and improvements will become apparent to the skilled artisan. Such other features, modifications, and improvements are, therefore, considered to be a part of this invention, the scope of which is to be determined by the following claims.

We claim:

1. A table adapted to accommodates a lamp having a self supporting base and a pole section extending therefrom, said table comprising:

a tabletop having first and second sections, said first and second sections each having an interior edge that defines one portion of an interior opening within said tabletop, said interior opening being sufficiently sized to surround a portion of the pole section of said lamp without being fixedly attached to said lamp, said sections further being pivotally connected to one another near one end of each of said respective edges to allow an opposite end of said sections to be moved away from one another to permit access to said opening in a horizontal plane; and a table support supporting said first and second sections of said tabletop, said table support further extending downwardly from said tabletop and being laterally spaced from said interior opening of said tabletop to thereby provide an independent support structure for said tabletop.

2. The device of claim 1, wherein said base comprises a plurality of legs.

3. The device of claim 2, wherein said legs are located substantially at corners of said tabletop.

4. The device of claim 1, further comprising releasable means for securing said first section to said second section.

5. The device of claim 1, further comprising means for supporting said first and second sections located underneath both of said sections and connected to only one of said sections.

6. The device of claim 1, further comprising an apron located below said tabletop, said apron further comprising a front swing arm movable from a first position under said tabletop to a second position where it permits access to said interior edges of said first and second sections.

7. The device of claim 6, wherein said apron further comprises first and second side panels and a rear panel between said first and second side panels, said rear panel having first and second members, said first member being joined to said side panel at one end and being pivotally connected at its opposite end to one end of said second member.

8. The device of claim 1, wherein said tabletop is rectangular.

9. The device of claim 1, wherein said base has a first and second ends, said first end being connected to said tabletop and further comprising a removable shelf between said tabletop and said second end of said base, said tabletop, said shelf further comprising an interior aperture thereto that is vertically aligned with said opening defined by said first and second sections of said tabletop.

10. The device of claim 1, wherein said tabletop is circular.

11. The device of claim 10, further comprising an apron located below said tabletop, wherein the edges of said apron are located in close proximity to the outer circumference of said tabletop in a configuration that maximizes a square under the said circular tabletop.

12. A method of inserting a torchier having a base and a lamp portion connected by a midsection in a tabletop having first and second sections and a table support, each of said sections having an interior edge that defines one portion of an interior opening within said tabletop, said sections further being pivotally connected to one another near one end of each of said respective edges, comprising the steps of:

supporting said first and second sections on said table support, moving at least one of said first and second sections away from said other section while they are still connected;

inserting the torchier into the interior opening of said table by moving the midsection of said torchier in a horizontal plane from a location outside the outer edge of said tabletop through the interior of said tabletop and into said opening while said first and second sections are connected; and moving at least one of said first and second sections toward said other section while they are still connected until a portion of the midsection of said torchier is surrounded by said interior opening without being fixedly attached to said tabletop, whereby said first and second table sections are independently supported by said table support.

* * * * *